US011845595B2

(12) United States Patent
Puccini et al.

(10) Patent No.: US 11,845,595 B2
(45) Date of Patent: Dec. 19, 2023

(54) CONTAINER MANAGEMENT SYSTEM

(71) Applicant: G.D S.P.A., Bologna (IT)

(72) Inventors: Anthony Puccini, Covington, KY (US); András Selmeczy, Offenbach (DE); Sip Hoo Liew, Selangor (MY); Enrico Bernardi, Bologna (IT); Gabriele Benni, Anzola dell'Emilia (IT)

(73) Assignee: G.D S.P.A., Bologna (IT)

( * ) Notice: Subject to any disclaimer, the term of this patent is extended or adjusted under 35 U.S.C. 154(b) by 0 days.

(21) Appl. No.: 18/037,235

(22) PCT Filed: Nov. 25, 2020

(86) PCT No.: PCT/EP2020/083349

§ 371 (c)(1),
(2) Date: May 16, 2023

(87) PCT Pub. No.: WO2022/106042

PCT Pub. Date: May 27, 2022

(65) Prior Publication Data

US 2023/0322454 A1 Oct. 12, 2023

Related U.S. Application Data

(60) Provisional application No. 63/114,659, filed on Nov. 17, 2020.

(51) Int. Cl.
*B65D 55/02* (2006.01)

(52) U.S. Cl.
CPC ..... *B65D 55/02* (2013.01); *B65D 2201/00* (2013.01)

(58) Field of Classification Search
CPC .... B65D 55/02; B65D 79/02; B65D 2201/00; B65D 81/24; B65D 2203/12; B65D 2255/00; B65D 51/245; G01N 33/00
See application file for complete search history.

(56) References Cited

U.S. PATENT DOCUMENTS

2012/0107191 A1* 5/2012 Strahle ..... G01N 21/78 422/401

FOREIGN PATENT DOCUMENTS

EP 1688358 A1 * 8/2006 ..... B65D 41/04
EP 1688358 A1 8/2006
(Continued)

OTHER PUBLICATIONS

Search Report and Written Opinion issued in International Application No. PCT/EP2020/083349, dated Sep. 3, 2021, 15 pages.

*Primary Examiner* — Javier A Pagan
(74) *Attorney, Agent, or Firm* — Dilworth IP, LLC

(57) ABSTRACT

A container management system including a lid assembly configured to engage/disengage a collar of a container to close and open an aperture thereof, wherein the lid assembly includes an interior lid compartment in communication with an interior portion of the container when the lid assembly engages the collar, a reactive substance configured to undergo a physical change in response to a change of an environment condition at the aperture when the lid assembly engages the collar. The physical change of the reactive substance turns the lid assembly from a first operative condition wherein the lid assembly can be disengaged from the collar to open the aperture to a second operative condition wherein a portion of the lid assembly cannot be disengaged from the collar and closes the aperture.

16 Claims, 6 Drawing Sheets

(56) References Cited

FOREIGN PATENT DOCUMENTS

| | | | | | |
|---|---|---|---|---|---|
| GB | 2474537 | A | * | 4/2011 | ..... B65D 51/24 |
| GB | 2474537 | A | | 4/2011 | |
| WO | 2015185889 | A1 | | 12/2015 | |
| WO | WO-2015185889 | A1 | * | 12/2015 | ..... G01N 33/0001 |
| WO | WO-2018104852 | A1 | * | 6/2018 | ..... B29D 22/003 |

* cited by examiner

CONTAINER MANAGEMENT SYSTEM

FIELD OF THE INVENTION

The present invention relates to a container management system, in particular to a management system for a container configured to contain foodstuffs either edible or drinkable.

BACKGROUND

Foodstuffs in containers are subjected to spoiling at very different rate depending on the type of edible or drinkable food, on the storage condition of the container before opening and on the storage condition of the container after opening and partial consumption of the foodstuffs.

To ensure freshness and safety, foodstuffs containers are labelled with expiry dates or "best before" dates, so that a consumer is warned about possible spoiling of the foodstuffs contained in the containers. A consumer is thus prevented from eating or drinking spoiled foodstuffs.

Expiry dates or "best before" dates are calculated empirically or by modelling both the container properties and the foodstuffs properties in a laboratory. A safety margin is included in the expiry dates or "best before" dates, so that the actual expiry dates of foodstuffs is often well after the labelled expiry dates or "best before" dates.

This causes a huge and unnecessarily waste of edible and drinkable foodstuffs and/or containers since containers still containing safe to eat or to drink foodstuffs are thrown away at the indicated expiry dates or even before such dates.

On the other side, it can occur that foodstuffs contained in containers improperly transported or improperly stored or improperly used are subjected to accelerate spoilage so that the actual expiry dates are well before the labelled and suggested ones.

This could cause both the colour and the flavour of foodstuffs to be adversely affected and in some cases that the amount of microbes developed renders the foodstuffs harmful to eat or to drink.

The Applicant has observed that foodstuffs spoiling is an alteration of the food quality that causes a transformation of one or more chemical, physical and biological component of the foodstuffs.

The Applicant has also observed that such a transformation often produces gaseous substances, such as amines or other volatile bases.

In the Applicant's experience a method for evaluating foodstuffs spoilage can be based on the detection of such gaseous substances within the containers and on the provision to a consumer of an indication of the food quality so as to warn the consumer about unsafe spoilage levels.

As an example, US20120107191A1 discloses a food quality indicator which includes a bio-indicator insert interposed between a gas-permeable, waterproof base and an impervious transparent cover, the base and the cover being sealed together at their peripheries to completely enclose the bio-indicator insert therebetween. The bio-indicator insert includes a porous substrate onto which a biosensor solution is applied, the biosensor solution being at least partially externally visible through the transparent cover. In use, the biosensor solution is adapted to change color within a defined color range that is dependent upon the concentration of amines detected. In this manner, the food quality indicator provides the consumer with a visual indication of the state of microbial spoilage experienced by a food product in close proximity thereto.

The Applicant has observed that a food quality indicator of the type disclosed in US20120107191A1 could be integrated into a cap or lid of a container for preventing the consumer from eating or drinking the content of the container in case of unsafe spoilage level.

However, the Applicant has noted that blind or partially sighted consumers as well as consumers with learning difficulties, children and consumers having never learned to read would be prevented from properly distinguishing or understanding the warning provided by the food quality indicator above summarized, so resulting in the possibility to eat or drink spoiled foodstuffs.

The Applicant has considered the problem of providing a system that effectively prevents any consumer, irrespective from the level of instruction, the age, any sensorial or learning dysfunction, from eat or drink spoiled foodstuffs.

Throughout this description and in the following claims, the following definitions apply.

The expression "state of matter" is used to indicate one of the distinct forms in which matter can exist, in particular the solid form, the liquid form and the gas form.

The expression "physical property" is used to indicate any property that is measurable or detectable to provide an information about a state or condition of a substance. Not exhaustive examples of physical properties falling within the above definition are: colour, boiling point, melting point, density, viscosity, adhesiveness, volume.

The expression "adhesiveness" or "adhesivity" is used to indicate the tendency of distinct surfaces or elements to stick to one another.

The expression "reactive substance" is used to indicate a substance capable to react upon contacting another substance and undergo to a physical or chemical modification.

The expression "environment condition" is used to indicate a state, a condition or a composition of the atmosphere in a confined space at a particular time.

SUMMARY

The Applicant has perceived that the change in at least one of the physical properties of a reactive substance can be used to trigger a change in how a lid cooperates with a collar of a container. In particular, the Applicant has thought that by providing a lid assembly with a reactive substance that, in a first operative condition thereof, allows the lid assembly to engage and disengage the collar of the container in a conventional way and that, in a second operative condition thereof, prevents the lid assembly from being disengaged from the collar, the foodstuffs contained in the container cannot be accessed when the reactive substance is in the second operative condition thereof.

The Applicant has found that by letting the second operative condition of the reactive substance be triggered by a change in an environment condition caused by one or more gaseous substances produced upon foodstuffs spoiling, the spoiled foodstuffs in the container cannot be longer accessed irrespective from the level of instruction, the age, any sensorial or learning dysfunction and the willing of a consumer.

Accordingly, in a first aspect thereof, the present invention relates to a container management comprising a lid assembly configured to engage and disengage a collar of a container to close and open an aperture of the container.

Preferably, the lid assembly comprises an interior lid compartment in fluid communication with an interior portion of the container through the aperture of the container when the lid assembly engages said collar.

Preferably, the lid assembly comprises a reactive substance contained in the interior lid compartment.

Preferably, the reactive substance is configured to undergo a change in at least one of its physical properties in response to a change of an environment condition at said aperture when the lid assembly engages said collar.

Preferably, said change in at least one of the physical properties of the reactive substance turns said lid assembly from a first operative condition to a second operative condition.

Preferably, in the first operative condition said lid assembly can be disengaged from said collar in order to open said aperture.

Preferably, in the second operative condition at least one portion of said lid assembly is prevented from disengaging from said collar and closes said aperture.

In a second aspect thereof, the present invention relates to a lid assembly for a container.

Preferably, the lid assembly comprises an interior lid compartment.

Preferably, the interior lid compartment is in fluid communication with an interior portion of the container when the lid assembly is engaged to the container.

Preferably, the lid assembly comprises a reactive substance contained in the interior lid compartment.

Preferably, the reactive substance is configured to undergo a change in at least one of its physical properties in response to a change of an environment condition at the interior lid compartment.

Preferably, when the lid assembly is engaged to the container said change in at least one of the physical properties of the reactive substance turns said lid assembly from a first operative condition to a second operative condition.

Preferably, in the first operative condition said lid assembly can be disengaged from the container.

Preferably, in the second operative condition at least one portion of said lid assembly is prevented from disengaging from the container.

Throughout this description and in the following claims, the expressions "axial" and "axially" refer to a direction substantially coinciding with or substantially parallel to a reference direction that the lid assembly follows when moving away from the collar. Such a direction can coincide with a symmetry axis of the collar.

Throughout this description and in the following claims, the expressions "radial" and "radially" refer to a direction that lies in a plane substantially perpendicular to said reference direction and that intersects such a reference direction.

Throughout this description and in the following claims, the expression "circumferential" refers to a direction around the reference direction.

In any one of the abovementioned aspects the features discussed below can be provided, individually or in combination with each other.

The change of the environment condition that triggers the change in at least one of the physical properties of the reactive substance is caused by one or more substances, preferably gaseous substances, representative of foodstuffs spoiling or produced upon spoiling of the foodstuffs contained in the container.

For example, said change of environment condition can be caused by a change of pH, amines types or quantity (preferably an increase in amines quantity) or temperature in the atmosphere confined within the container.

The change of environment condition can also be caused by a change of one or more of: solvent composition, electric field, pressure, ionic strength, magnetic field, moisture (humidity), microbial load (in particular referring, but not exclusively, to bacteria, mold and yeasts) and related gaseous substances produced by microbial spoilage, immunoglobulins (in particular, type G).

Preferably, said change in at least one of the physical properties of the reactive substance is irreversible, so that the reactive substance cannot returns to its original condition once the change in at least one of its physical properties has occurred.

The change irreversibility of the physical property or properties of the reactive substance prevents the container from being opened irrespective from any attempt to simulate the safety of the foodstuffs contained in the container once the foodstuffs are actually spoiled. As an example, restoring the environment condition in the container would not allow the disengagement of the lid assembly from the container.

Preferably, the second operative condition of the lid assembly is an irreversible condition, so that the lid assembly can be only switched from the first operative condition to the second operative condition and not even from the second operative condition to the first operative condition. This prevents the lid assembly from being disassembled from the collar once the lid assembly has been triggered in the second operative condition.

Preferably, in the first operative condition of the lid assembly said at least one portion of the lid assembly can have a combined rotational and translational motion with respect to the collar in order to open said aperture.

Preferably, said change in at least one of the physical properties of the reactive substance allows the reactive substance to modify the mechanical interaction between components of the lid assembly or between components of both the lid assembly and the collar, so as to turn the lid assembly from the first operative condition to the second operative condition.

Preferably, in the second operative condition of the lid assembly the translational motion of said at least one portion of the lid assembly relative to the collar is prevented.

Alternatively, in the second operative condition of the lid assembly the rotational motion of said at least one portion of the lid assembly relative to the collar is prevented.

Alternatively, in the second operative condition of the lid assembly both the translational motion and the rotational motion of said at least one portion of the lid assembly relative to the collar is prevented.

Preferably, said lid assembly comprises a lid casing containing said interior lid compartment.

Preferably, said lid assembly comprises an upper portion and a lateral portion.

Preferably, the lateral portion is configured to engage and disengage said collar.

Preferably, the lateral portion of the lid casing comprises a threaded surface counter-shaped to a threaded surface of the collar, so that the lid assembly can be disengaged from the collar by rotating the lid casing with respect to the collar. Such a rotation causes a translation of the lid assembly with respect to the collar and the whole disengagement of the lid assembly from the collar.

Preferably, said lid assembly comprises a membrane associated with said lid casing.

Preferably, said reactive substance is arranged between said membrane and the upper portion of the lid casing.

Preferably, said membrane is permeable to at least one gaseous substance.

More preferably, said membrane is exposed to the gaseous substances produced upon spoiling of foodstuffs contained in the container. These gaseous substances are responsible of the change of the environment condition that triggers the change in the physical properties of the reactive substance.

Preferably, said membrane is impermeable to said reactive substance. This allows to prevent the reactive substance from directly contacting the foodstuffs contained in the container at least when the reactive substance is in the initial operative condition thereof, namely before one or more of the physical properties of the reactive substance have changed.

Preferably, the lid assembly is triggered from the first operative condition to the second operative condition by the change of just one physical property of the reactive substance, irrespective of possible other changes in physical properties of the reactive substance.

Preferably, said reactive substance comprises hydrogels.

The word "hydrogels" is used herein to indicate networks of polymer chains extensively swollen with water or, in other words, water-swollen and cross-linked polymeric networks produced by the simple reaction of one or more monomers.

Hydrophilic gels are usually referred to as hydrogels. Sometimes they are found as colloidal gels in which water is the dispersion medium.

The word "hydrogels" is also used herein to indicate a polymeric material that exhibits the ability to swell and retain a significant fraction of water within its structure but does not dissolve in water.

Common examples of hydrogels comprise polyvinyl alcohol, sodium polyacrylate, polysaccharides (in particular, starch or cellulose ethers), silicons, acrylate polymers and copolymers with an abundance of hydrophilic groups.

Alternatively, said reactive substance comprises immunosensors, or magnetoelastic sensors, or gas sensors.

Preferably, said at least one of the physical properties of the reactive substance is selected among volume, and/or state of matter, and/or adhesiveness.

In first embodiments, the change in volume, state of matter or adhesiveness of the reactive substance modifies the mechanical interaction between components of the lid assembly.

In second embodiments, the change in volume, state of matter or adhesiveness of the reactive substance modifies the mechanical interaction between components of the lid assembly.

At least in the abovementioned first embodiments, said lid assembly preferably comprises a lid internal cap arranged inside said lid casing.

Preferably, the change in volume, state of matter or adhesiveness of the reactive substance modifies the mechanical interaction between the lid internal cap and the lid casing.

More preferably, when the lid assembly is in the first operative condition the lid internal cap and the lid casing are coupled to each other so that the lid internal cap and the lid casing rotate as a single body with respect to the collar.

Preferably, when the lid assembly is in the first operative condition the lid internal cap and the lid casing are coupled to each other so that the lid internal cap and the lid casing translate or slide as a single body with respect to the collar.

Accordingly, when the lid assembly is in the first operative condition, the lid internal cap can be removed from the collar along with the lid casing.

Preferably, when the lid assembly is in the second operative condition the lid internal cap and the lid casing are decoupled so that the lid casing rotates independently from the lid internal cap with respect to the collar.

More preferably, when the lid assembly is in the second operative condition the lid internal cap and the lid casing are decoupled so that the lid casing translates or slides independently from the lid internal cap with respect to the collar. This prevents the lid internal cap from being removed from the collar when the lid casing is disengaged from the collar.

Preferably, said lid internal cap and said collar are coupled through a bayonet coupling when the lid assembly engages said collar.

Accordingly, when the lid assembly is in the second operative condition the lid casing is disengaged from the collar and the lid internal cap remains coupled to the collar.

Preferably, the lid internal cap comprises an upper wall facing the upper portion of the lid casing.

Preferably, the lid internal cap comprises a lateral wall configured to couple with a radially inner surface of the collar.

The upper wall and the lateral wall of the internal cap are preferably configured to close the aperture of the container, so as to prevent the content of the container from being accessed.

Preferably, said membrane defines at least one portion of the upper wall of the internal cap.

Preferably, the reactive substance is contained between the lid internal cap and the lid casing.

More preferably, the reactive substance is contained between the upper wall of the lid internal cap and the upper portion of the lid casing.

Preferably, in the second operative condition of the lid assembly said reactive substance prevents said lid internal cap from disengaging from the collar.

Preferably, said change in at least one of the physical properties of the reactive substance is a change of the adhesiveness of the reactive substance.

Preferably, the reactive substance couples by adhesiveness said lid internal cap to said lid casing in the first operative condition of the lid assembly and decouples said lid internal cap from said lid casing in the second operative condition of the lid assembly.

Preferably, the reactive substance couples by adhesiveness the upper wall of the lid internal cap and the upper portion of the lid casing.

When the reactive substance changes its adhesiveness, the lid internal cap is decoupled from said lid casing, thus allowing the lid casing to be disengaged from the collar and the lid internal cap to remain coupled to the collar.

Preferably, said lid internal cap and said collar comprise respective lower abutment surfaces configured to abut to each other when the lid assembly engages said collar in order to prevent the lid internal cap to fall inside the container in the second operative condition of the lid assembly.

At least in the abovementioned second embodiments, preferably, when the lid assembly is in the second operative condition the lid casing is prevented from rotating with respect to the collar.

Preferably, when the lid assembly is in the second operative condition the lid casing is prevented from translating with respect to the collar.

More preferably, in the second operative condition of the lid assembly said reactive substance irremovably couples said lid casing to said collar.

Preferably, said lid assembly comprises a lid expansion space defined between said interior lid compartment and the lateral portion of the lid casing.

Preferably, said change in at least one of the physical properties of the reactive substance is a volume increase of the reactive substance.

Preferably, the reactive substance fills said lid expansion space in the second operative condition of said lid assembly.

Accordingly, when the reactive substance is triggered by the change in the environment condition, the reactive substance increases its volume and expands from the interior lid compartment into the lid expansion space. As the reactive substance fills the lid expansion space, the lid casing is prevented from detaching from the collar.

To this end, said collar preferably comprises an anchoring surface facing said lid expansion space when the lid assembly is engaged with said collar.

Preferably, the reactive substance is far from said anchoring surface in the first operative condition of the lid assembly and engages said anchoring surface in the second operative condition of the lid assembly.

Preferably, the interaction between the expanded reactive substance and the anchoring surface constrains the expanded reactive substance to the collar.

Preferably, the expanded reactive substance is constrained to the upper portion of the lid casing and the upper portion of the lid casing is constrained to the threaded surface of the lateral portion of the lid casing, so that the lateral portion of the lid casing is prevented from being unscrewed from the threaded surface of the collar.

Preferably, said anchoring surface is annular and wedge shaped along an axial direction. However, the anchoring surface can have any different shape which is suitable for performing the same function performed by the abovementioned annular and wedge shape.

BRIEF DESCRIPTION OF THE DRAWINGS

The present invention will be now described in more detail hereinafter with reference to the accompanying drawings, in which some, but not all the embodiments of the invention are shown and wherein.

DETAILED DESCRIPTION

Figure 1:
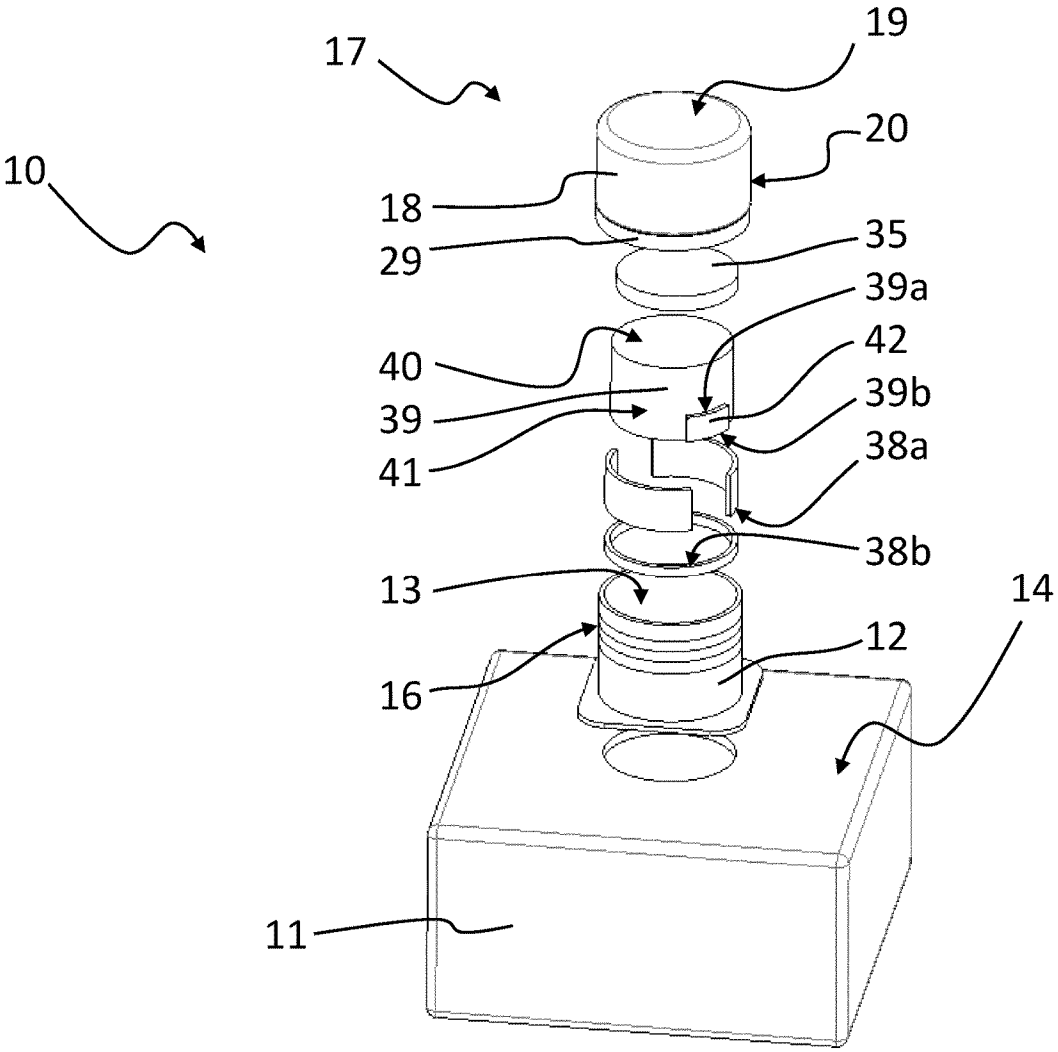
FIG. 1 shows a partial, schematic and exploded perspective view of a first embodiment of a container management system according to the present invention.

In the abovementioned Figures, a container management system according to the present invention is indicated with the reference number 10.

The container management system 10 comprises a container 11 configured to hold foodstuffs. The container 11 can be any receptacle suitable for safely containing a substance to eat or drink.

The container 11 can be a rigid or semi-rigid casing made of glass, plastic material or cardboard having any suitable shape, for example a prismatic or cylindrical shape.

The container 11 comprises a collar 12 surrounding an aperture 13 configured to allow the substance to exit from the container 11.

The collar 12, and thus the aperture 13, is provided on an upper wall 14 of the container 11. The collar 12 axially extends away from the upper wall 14 of the container 11. The collar 12 can be integral with the container 11 or can be a distinct body properly coupled to the container 11.

The collar 12 has a generic cylindrical shape, as shown in FIGS. 1, 2, 3 and 6.

The collar 12 comprises a radially outer surface 15.

Preferably, the radially outer surface 15 comprises, in at least one axial portion thereof, an outer threaded surface 16.

In the preferred embodiments of the invention, as those shown in FIGS. 1 to 8, the container management system 10 further comprises a lid assembly 17 configured to engage and disengage the collar 12 so as to close and open the aperture 13 of the container 11.

The lid assembly 17 comprises a lid casing 18 configured to be coupled to the collar 12 in order to close the aperture 13.

The lid casing 18 comprises an upper portion 19 and a lateral portion 20.

The upper portion 19 comprises a containment wall 21. In some embodiments, as for example the one shown in FIGS. 1 to 4, the containment wall 21 is a solid wall, whereas in other embodiments, as for example the one shown in FIGS. 5 to 8, the containment wall 21 comprises a window 22 which is preferably made of transparent material (see FIGS. 5 and 6).

The containment wall 21 is coupled to the lateral portion 20. Preferably, the containment wall 21 is integral with the lateral portion 20. In an alternative embodiment, the containment wall 21 may be connected to the lateral portion 20 via a thin-wall portion formed for example of resin, or may be pivotably connected to the lateral portion 20 via a hinge mechanism or the like.

Figure 4:
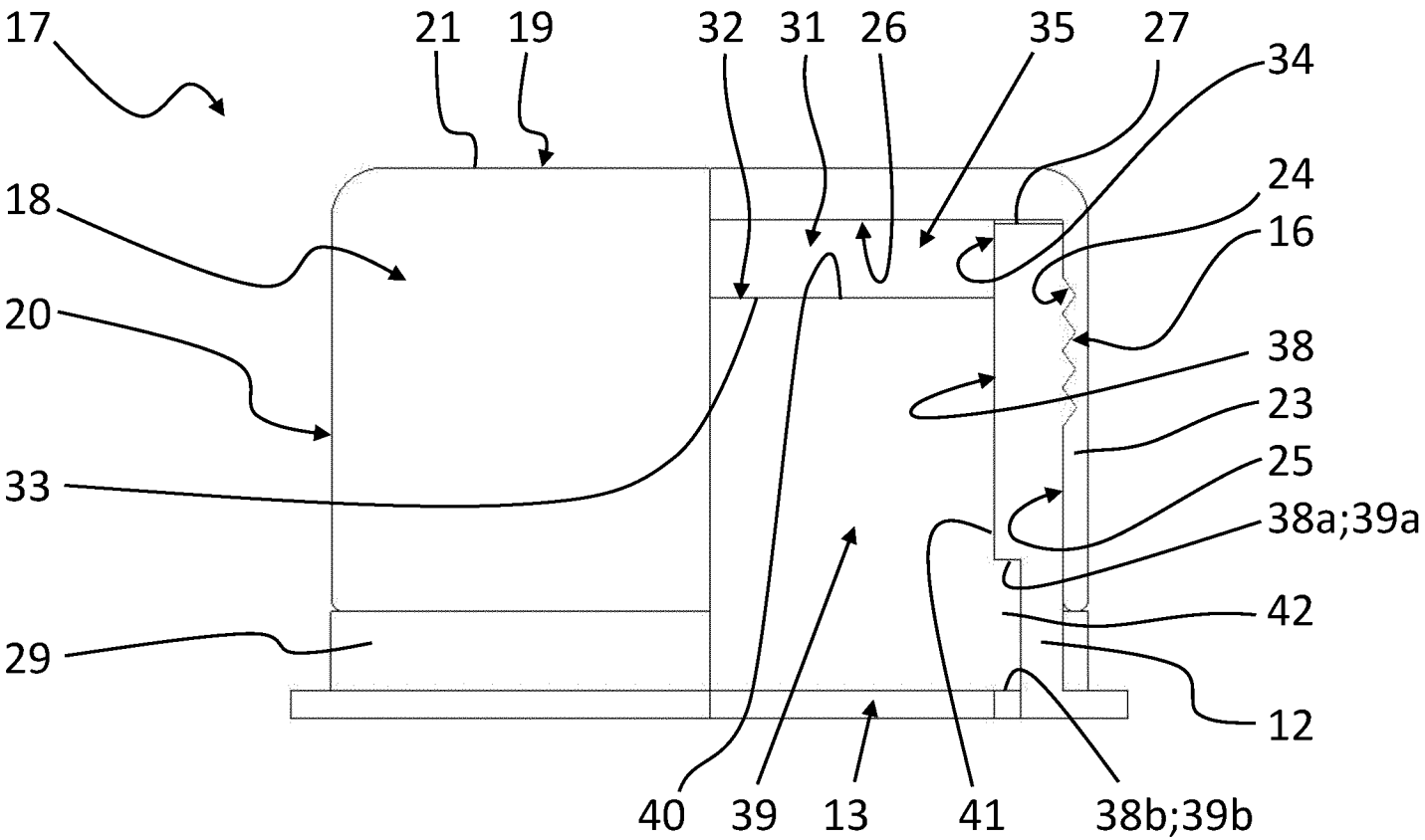
FIG. 4 shows a schematic view of a partial section of the container management system of FIGS. 1 to 3.
Figure 6:
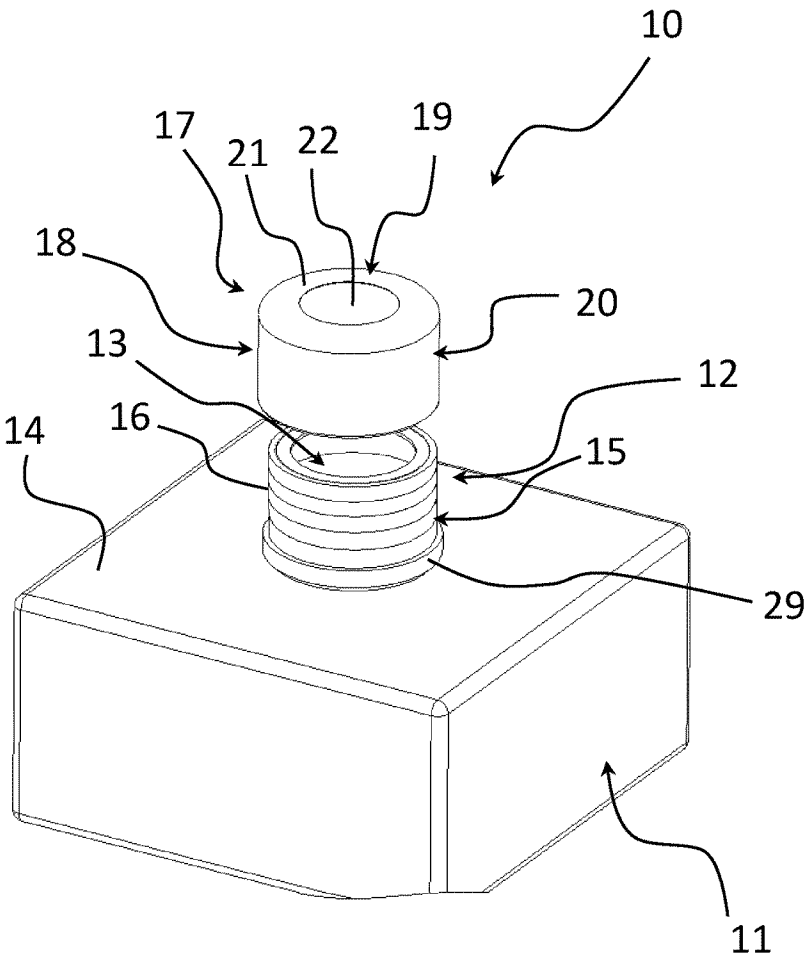
FIG. 6 shows a partial, schematic and exploded perspective view of the container management system of FIG. 5.
Figure 5:
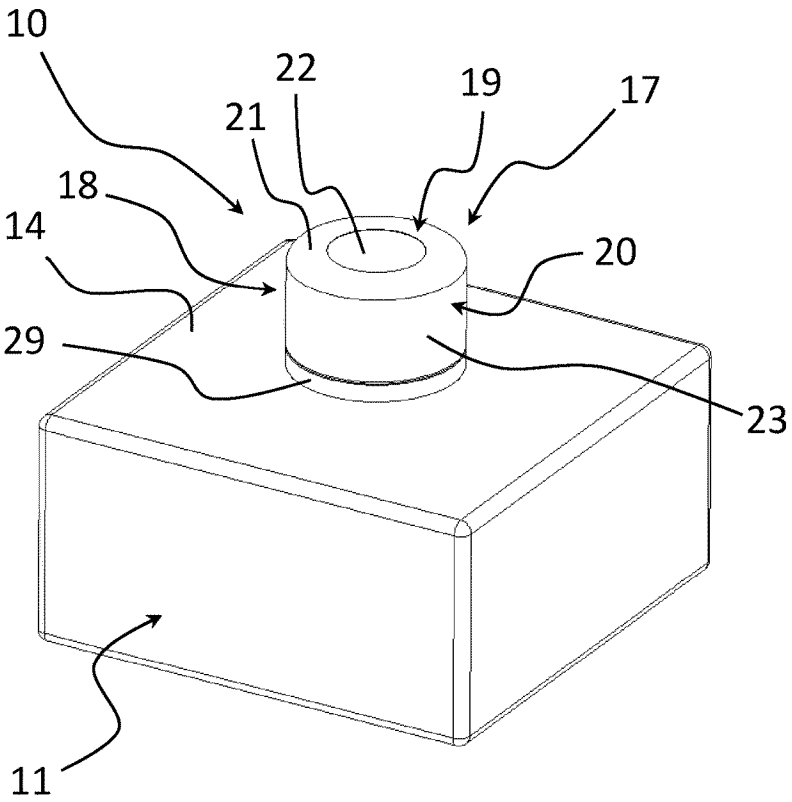
FIG. 5 shows a partial and schematic perspective view of a second embodiment of a container management system according to the present invention.
Figure 7:
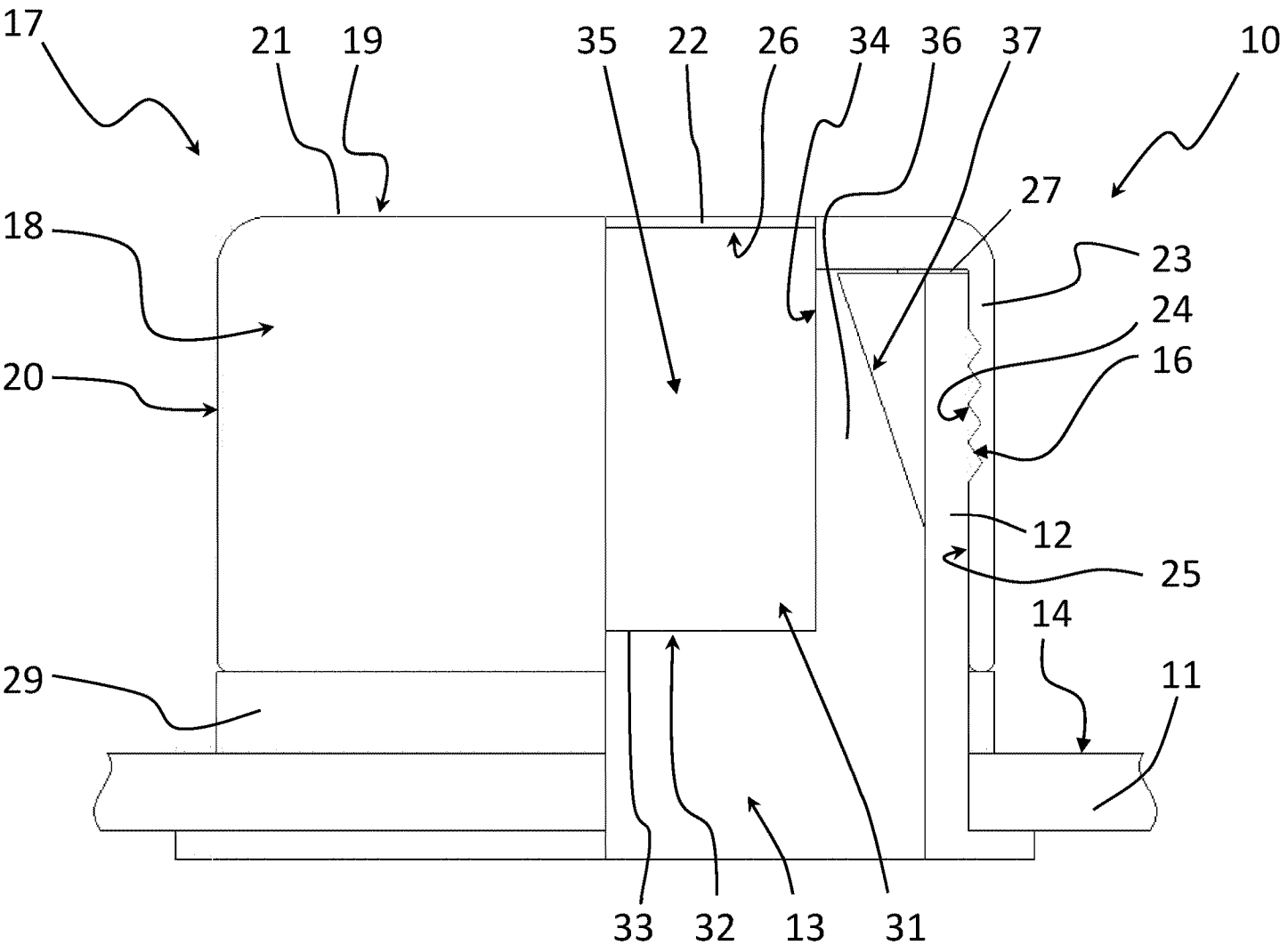
FIG. 7 shows a schematic view of a partial section of the container management system of FIG. 5 in a first operative condition thereof.
Figure 8:
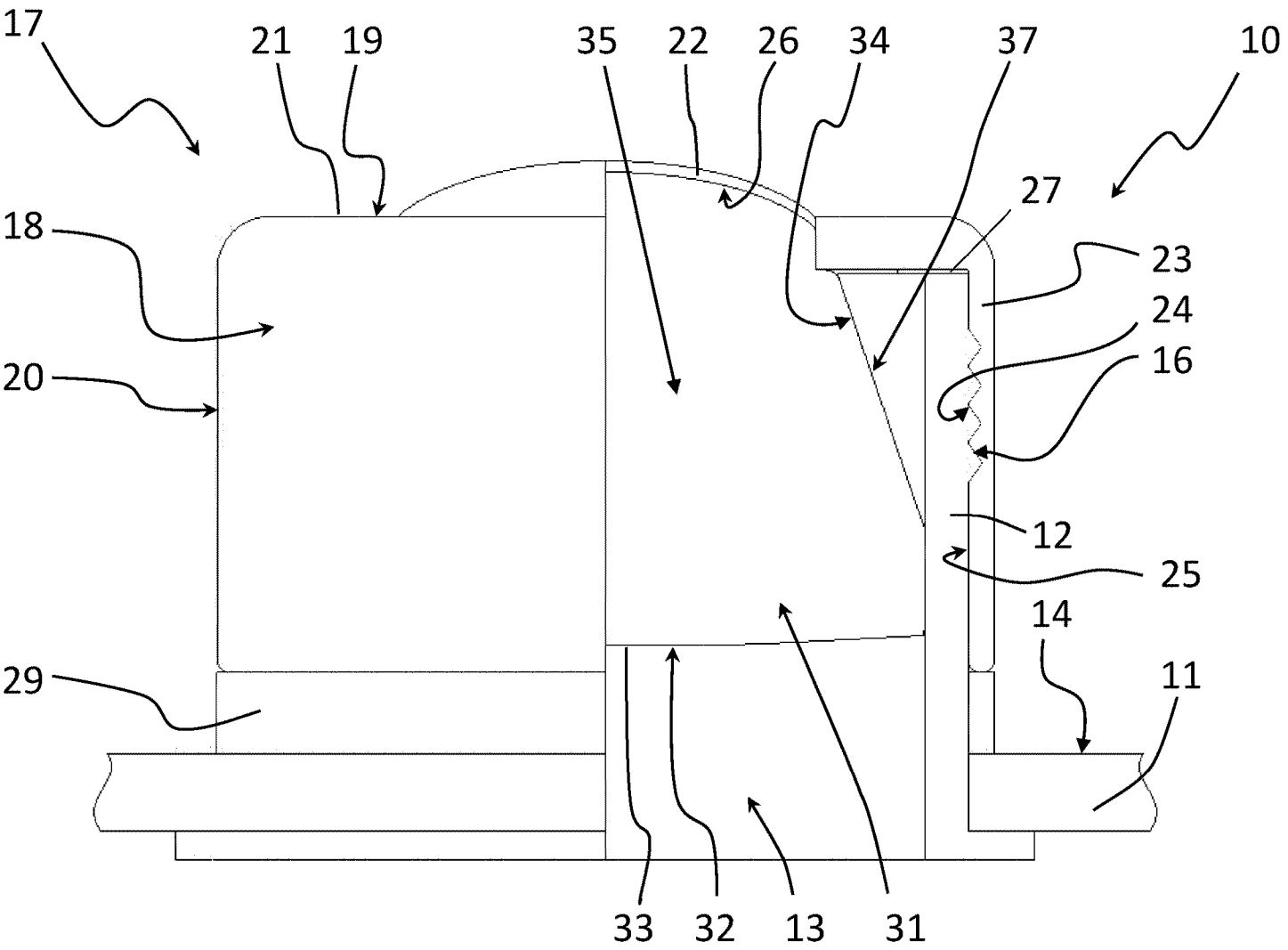
FIG. 8 shows a schematic view of a partial section of the container management system of FIG. 5 in a second operative condition thereof.

As schematically shown for example in FIGS. 4, 7 and 8, the lateral portion 20 comprises a lateral wall 23 having a radially inner surface 25.

Preferably, the radially inner surface 25 comprises, in at least one axial portion thereof, an inner threaded surface 24.

The inner threaded surface 24 of the lateral portion 20 is counter-shaped to the outer threaded surface 16 of the collar 12, so that the lid casing 18 can be screwed and unscrewed from the collar 12. By rotating the lid casing 18 with respect to the collar 12, the threaded surfaces 16, 24 cause a roto-translational movement of the lid casing 18 with respect to the collar 12.

As shown in FIGS. 4, 7 and 8, a gasket 27 is provided at an axially inner surface 26 of the containment wall 21. The gasket 27 is configured to be engaged by the collar 12 when the lid casing 18 is coupled to the collar 12 in order to prevent liquid and gaseous substances contained in the container 11 from escaping through possible gaps between the lid casing 18 and the collar 12.

A security seal 29 is provided between the lid casing 18 and the container 11 at a base portion of the collar 12, that is at the free edge of the lateral wall 23 which is axially opposite to the containment wall 21 when the lid casing 18 is coupled to the collar 12. The security seal 29 is configured to indicate that the container 11 has never been opened. The security seal 29 is annular shaped and radially surrounds the collar 12. The security seal 29 is coupled through a detachable flap to the abovementioned free edge of the lateral wall 23, so that at the first opening of the container 11 the detachable flap must be broken in order to allow the removal of the lid casing 18 from the collar 12.

The lid assembly 17 further comprises an interior lid compartment 31 configured to face the aperture 13 of the container 11 and in fluid communication with an interior portion of the container 11 through said aperture 13 when the lid assembly 17 engages the collar 12.

The interior lid compartment 31 is provided within the lid casing 18. In particular, the interior lid compartment 31 is defined between the upper portion 19 and the lateral portion 20 of the lid casing 18.

A membrane 32 delimits the interior lid compartment 31 within the lid casing 18. Such a membrane 32 is directly exposed to the content of the container 11, as it will be better illustrated in the following.

The membrane 32 comprises a bottom portion 33 opposite to the upper portion 19 of the lid casing 18, and a lateral portion 34 extending between the bottom portion 33 and the upper portion 19 of the lid casing 18. The membrane 32 is connected, for example at a peripheral edge thereof, to the lid casing 18 and defines a closed cavity defining the interior lid compartment 31.

A reactive substance 35 is contained within the interior lid compartment 31. Particularly, the reactive substance 35 is confined by the membrane 32.

The membrane 32 is permeable to one or more gaseous substances, such as for example amines, produced upon foodstuffs spoiling, so that these gaseous substances can reach the reactive substance 35.

In order to prevent the reactive substance 35 from directly contacting the foodstuffs provided within the container 11, the membrane 32 is impermeable to the reactive substance 35. In other words, the reactive substance 35 cannot exit from the closed cavity defined by the membrane 32.

In an exemplary embodiment of the invention, the reactive substance 35 is or comprises gels herein referred to as hydrogels.

The reactive substance 35 is configured to undergo a change in at least one of its physical properties when contacted by the gaseous substances produced upon foodstuffs spoiling, thus turning the lid assembly 17 from a first operative condition wherein said lid assembly 17 can be disengaged from the collar 12 in order to open the aperture 13 to a second operative condition wherein the lid assembly 17 is prevented from completely disengaging from the collar 12 and closes said aperture 13.

According to a first embodiment of the present invention, shown in FIGS. 1 to 4, the switch of the lid assembly 17 from the first operative condition to the second operative condition thereof is triggered by a change of the adhesiveness of the reactive substance 35 and, in particular, by the fact that the reactive substance 35 stops to be adhesive. The reactive substance 35 is therefore in an adhesive initial condition when not contacted by the gaseous substances produced upon foodstuffs spoiling and in a not-adhesive final condition when contacted by the gaseous substances produced upon foodstuffs spoiling.

In this embodiment, the lid assembly 17 comprises a lid internal cap 39 which is arranged inside the lid casing 18.

The lid internal cap 39 comprises an upper wall 40 that faces the upper portion 19 of the lid casing 18 and a lateral wall 41 that faces the lateral portion 20 of the lid casing 18. The upper wall 40 is integral with the lateral wall 41.

The upper wall 40 preferably coincides with at least part of the membrane 32. In particular, as shown in FIG. 4, the upper wall 40 is defined by the bottom portion 33 of the membrane 32.

The lateral wall 41 is counter-shaped to a radially inner surface 38 of the collar 12. The lateral wall 41 is spaced apart from the radially inner surface 25 of the lateral portion 20 of the lid casing 18 by a distance that is substantially equal to or slightly greater than the thickness of the collar 12. Preferably, a minimal dimensional difference or play can be provided between the diameter of the radially outer surface of the lateral wall 41 and the diameter of the radially inner surface 38 of the collar 12 in order to allow an easy insertion of the lid internal cap 39 within the collar 12 while maintaining a tight fitting between lid internal cap 39 and collar 12 and ensuring the sealing of the aperture 13.

In this embodiment one or more gaseous substances, produced for example upon foodstuffs spoiling, can reach the lateral portion 34 of the membrane 32 through the minimal play between the radially outer surface of the lateral wall 41 of the lid internal cap 39 and the radially inner surface 38 of the collar 12. As an alternative or in addition to this minimal play, the lid internal cap 39 can include at least one opening or channel (not illustrated) properly sized for the passage of the gaseous substances from the aperture 13 of the container 11 to the bottom portion 33 of the membrane 32. The membrane 32 is thus directly exposed to the content of the container 11.

As shown in FIG. 1 and partially in FIG. 4, the collar 12 comprises two upper abutment surfaces 38*a* and one lower abutment surface 38*b* that project in a radially outer direction from the radially inner surface 38 of the collar 12. The upper abutment surfaces 38*a* are axially spaced from the lower abutment surface 38*b*, the lower abutment surface 38*b* being arranged to be closer to the upper wall 14 of the container 11 than the upper abutment surfaces 38*a* when the collar 12 is coupled to the container 11. As a consequence, a circumferential groove is provided between the upper abutment surfaces 38*a* and the lower abutment surface 38*b*.

The lower abutment surface 38*b* extends continuously along the whole circumferential extension of the radially inner surface 38 of the collar 12, while each upper abutment surface 38*a* extends continuously along less than the half circumferential extension of the radially inner surface 38 of the collar 12 so that they are spaced to each other, preferably equally, at both their facing free ends. In alternative embodiments, a plurality of upper abutment surfaces having a limited circumferential extent on the radially inner surface 38 of the collar 12 and spaced to each other, preferably equally, can be provided. In further alternative embodiments, one abutment surface extending continuously along less than the whole circumferential extension of the radially inner surface 38 of the collar 12 can be provided, so that two free ends of this abutment surface are spaced to each other.

Consistently, the lid internal cap 39 comprises one or more protruding elements 42 that protrude in a radially outer direction from the lateral wall 41 of the lid internal cap 39. Each protruding element 42 includes an upper abutment surface 39*a* and a lower abutment surface 39*b* that are axially spaced from each other. With reference to the protruding element 42 of the lid internal cap 39 shown in FIGS. 1, 3, 4, the upper abutment surface 39*a* is closer to the upper wall 40 of the lid internal cap 39 than the lower abutment surface 39*b*. The upper abutment surface 39*a* is substantially orthogonal to the lateral wall 41 and configured to axially abut against the abutment surface 38*a* of the radially inner surface 38 of the collar 12, so as to define an end stop for the extraction of the internal cap 39 into the collar 12. On the other hand, the lower abutment surface 39*b* is also substantially orthogonal to the lateral wall 41 and configured to axially abut against the lower abutment surface 38*b* of the radially inner surface 38 of the collar 12, so as to define an end stop for the insertion of the internal cap 39 into the collar 12. The cooperation between the lower abutment surfaces 38*b*, 39*b* allows to prevent the lid internal cap 39 to fall inside the container 11 in the second operative condition of the lid assembly 17.

In order to allow the extraction/insertion of the lid internal cap 39 from/into the collar 12, the latter comprises a guide member 43 (shown in FIG. 2) configured to cooperate with the protruding element 42 of the lid internal cap 39. In the illustrated embodiment, the guide member 43 is an axial rectilinear groove perpendicular to the aforesaid circumferential groove of the collar 12. In particular, the guide member 43 inserts itself on said circumferential groove at a location where the upper abutment surfaces 38*a* of the collar 12 are spaced to each other.

In particular, as schematically shown in FIG. 4, the lid internal cap 39 and the collar 12 are coupled through a bayonet coupling when the lid assembly 17 engages the collar 12. The bayonet coupling is a fastening mechanism that comprises the protruding element 42 of the lid internal cap 39, the guide member 43 and the circumferential groove provided between the upper abutment surfaces 38*a* and the lower abutment surface 38*b* of the collar 12. The protruding element 42 slides into the circumferential groove, rotates around the same axis of rotation that allows the threaded surfaces 16, 24 to engage and disengage to/from each other, and axially retains the lid internal cap 39 coupled to the collar 12. The axial extent of the circumferential groove is greater than the axial extent of the protruding element 42, so that the latter is received with an axial play into the circumferential groove. The position of the protruding element 42 and of the circumferential groove is determined so as to allow the lid casing 18 to be screwed and unscrewed from the collar 12 only when the protruding element 42 reaches the circumferential groove, so that the protruding element 42 can slide into the circumferential groove when the lid casing 18 is screwed onto the collar 12.

In this embodiment the membrane 32 can detach from the lid casing 18 upon being subjected to a predetermined torsional force.

Figure 3:
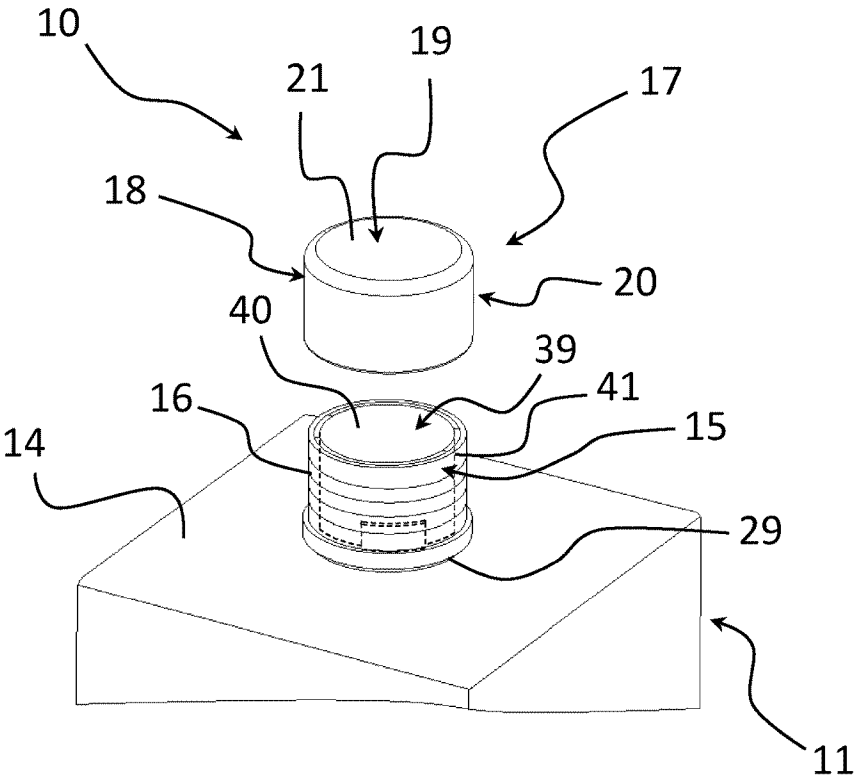
FIG. 3 shows a partial, schematic and exploded perspective view of the container management system of FIG. 1 in a second operative condition thereof.
Figure 2:
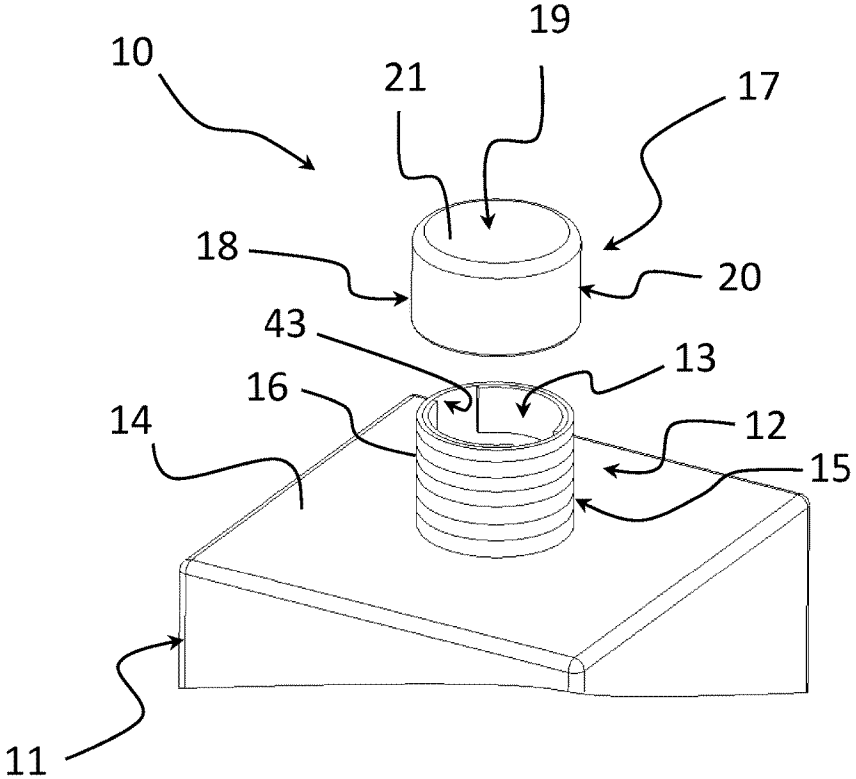
FIG. 2 shows a partial, schematic and exploded perspective view of the container management system of FIG. 1 in a first operative condition thereof.

When the reactive substance 35 turns from its adhesive initial condition to its not-adhesive final condition upon being contacted by the gaseous substances produced upon foodstuffs spoiling, the reactive substance turns the lid assembly 17 from its first operative condition (shown in FIG. 2) to its second operative condition (shown in FIG. 3).

In the first operative condition of the lid assembly 17, the lid internal cap 39 is made adhered to the lid casing 18 by the reactive substance which, being in its adhesive initial condition, sticks the upper wall (i.e. the membrane 32 in the example herein shown and described) of the internal lid 39 to the upper portion 19 of the lid casing 18. Thus, the lid assembly 17 can be disengaged from the collar 12 upon rotating the lid casing 18 respect to the collar 12, so as to open the aperture 13 and to have access to the content of the container 11.

Indeed, the rotation of the lid casing 18 causes a corresponding rotation of the lid internal cap 39. This allows the internal cap 39 to disengage from the collar 12. Particularly, the rotation of the internal cap 39 releases the bayonet coupling, thereby allowing the protruding element 42 to slide along the guide member 43, that is allowing the internal cap 39 to slide along the collar 12 and to disengage from the collar 12.

In the second operative condition of the lid assembly 17, the lid casing 18 can still be disengaged from the collar 12, but since the reactive substance 35 is in its not-adhesive final condition, the reactive substance 35 does not adhere to the upper wall 40 of the lid internal cap 39 (i.e. to the membrane 32 in the example herein shown and described). In this condition, the rotation of the lid casing 18 causes the membrane 32 to detach from the lid casing 18, so that the rotation of the lid casing 18 does not cause also the rotation of the lid internal cap 39. Thus, the lid internal cap 39 remains coupled to the collar 12 and cannot be disengaged from the collar 12 irrespective from the disengagement of the lid casing 18 from the collar 12, thereby preventing the aperture 13 from being opened.

It should be also noted that, even in case of disruption of the reactive substance 35, the coupling of the lid internal cap 39 to the collar 12 in the second operative condition is ensured by the cooperation between the upper abutment surfaces 38*a*, 39*a*. In more detail, when a partial change of the physical properties of the reactive substance 35 occurs, a weak residual adherence lasts between the reactive substance 35 and the upper wall 40 of the lid internal cap 39 at few points. At these few points of residual adherence, the membrane 32 is elastically attached to the lid casing 18 and the lid internal cap 39, therefore the rotation of the lid casing 18 causes a shorter rotation of the lid internal cap 39. Due to this shorter rotation, the protruding element 42 slides into the circumferential groove but does not reach the guide member 43. Then, when the threaded surfaces 16, 24 are disengaged from each other and a force is applied to disengage the lid casing 18 from the collar 12, the upper abutment surface 39*a* of the protruding element 42 of the lid internal cap 39 abuts against the abutment surface 38*a* of the radially inner surface 38 of the collar 12. As the lid casing 18 is forced to be disengaged from the collar 12 and the upper abutment surfaces 38*a*, 39*a* cooperate to each other, the membrane 32 definitely detaches from the lid casing 18. This allows the lid casing 18 to be disengaged from the collar 12 and the lid internal cap 39 to remain into the collar 12 preventing the aperture 13 from being opened.

According to a second embodiment of the present invention, shown in FIGS. 5 to 8, the reactive substance 35 is confined by the membrane 32 and contained within the interior lid compartment 31. The membrane 32, in particular, is deformable.

The switch of the lid assembly 17 from the first operative condition to the second operative condition thereof is triggered by a change of the volume of the reactive substance 35 and, in particular, by the fact that the volume of the reactive substance 35 increases. The reactive substance 35 is therefore in an unexpanded initial condition when not contacted by the gaseous substances produced upon foodstuffs spoiling and in an expanded final condition when contacted by the gaseous substances produced upon foodstuffs spoiling.

In this embodiment, the lid assembly 17 comprises a lid expansion space 36 configured to receive the reactive substance 35 when it is in its expanded condition.

The expansion space 36 is defined between the lateral portion 20 of the lid casing 18 and the interior lid compartment 31 and is delimited in an axial direction by the upper portion 19 of the lid casing 18. In other words, the expansion space 36 is defined by the portion of lid casing 18 not occupied by the interior lid compartment 31. As shown in FIG. 7, the expansion space 36 is substantially an empty space when the reactive substance 35 is in its unexpanded initial condition. As shown in FIG. 8, the reactive substance 35 fills the expansion space 36 when the reactive substance is in its expanded final condition.

In this embodiment, the collar 12 comprises an anchoring surface 37 that faces the lid expansion space 36 when the lid casing 18 is engaged with the collar 12. The anchoring surface 37 is preferably annular and wedge shaped along an axial direction. The anchoring surface 37 is provided on a radially inner surface 38 of the collar 12 and radially projects into the lid expansion space 36 toward the interior lid compartment 31, as shown in FIGS. 7 and 8. The anchoring surface 37 can be integral with the collar 12 or it can be a body connected to the collar 12.

FIGS. 7 and 8 show one anchoring surface 37 circumferentially extending from the whole collar 12. In embodiments not shown, the anchoring surface 37 can have a limited circumferential extension. In this case, more than one anchoring surface 37 circumferentially arranged on the collar 12 can be provided.

In this embodiment one or more gaseous substances, produced for example upon foodstuffs spoiling, can reach the membrane 32 for example through the lid expansion space 36.

When the reactive substance 35 turns from its unexpanded initial condition to its expanded final condition upon being contacted by the gaseous substances produced upon foodstuffs spoiling, the reactive substance 35 turns the lid assembly 17 from its first operative condition (shown in FIG. 7) to its second operative condition (shown in FIG. 8).

In the first operative condition, the anchoring surface 37 does not interact with the reactive substance 35, with the lid casing 18 and with the interior lid compartment 31, so that the lid assembly 17 can be disengaged from the collar 12 upon rotating the lid casing 18 respect to the collar 12, thereby opening the aperture 13 and having access to the content of the container 11.

In the second operative condition, the reactive substance 35 is in its expanded condition and fills the lid expansion space 36. The reactive substance 35 interacts with the anchoring surface 37 and couples the lid casing 18 to the anchoring surface 27 and thus to the collar 12. This prevents the lid casing 18 from being able to translate in the axial direction with respect to the collar 12. Thus, the lid assembly 17 cannot be disengaged from the collar 12, thereby preventing the opening of the aperture 13 and the access to the content of the container 11.

In this embodiment, the membrane 32 can be elastically deformable so that it can contain the reactive substance 35 also when the latter is in its expanded final condition, especially when the reactive substance is a gel. Alternatively, the membrane 32 can break when the reactive substance 35 is in its expanded final condition, thereby no longer containing the reactive substance 35. In this alternative case the reactive substance 35 is solid at least in its expanded final condition. Any possible contamination of the content of the container 11 by the reactive substance 35 when it is in its expanded final condition is immaterial, since the content of the container 11 cannot be accessed and cannot be eaten or drunk.

In this embodiment, the reactive substance 35 can also bulges from the window 22 of the containment wall 21 (as shown in FIG. 8) when it is in its expanded condition, so as to give a tactile and visible hint about the fact that the lid assembly 17 is in the second operative condition and the content of the container 11 is no longer safe. To this end, the window 22 can be realized from an elastic material impermeable to the reactive substance 35.

Of course, one skilled in the art can provide for modifications and variants to the invention described above in order to satisfy specific and contingent requirements, all encompassed by the scope of the present invention as defined by the following claims.

The invention claimed is:

1. A container management system, comprising a lid assembly configured to engage and disengage a collar of a container to close and open an aperture of the container, wherein the lid assembly comprises:

an interior lid compartment in fluid communication with an interior portion of the container through the aperture of the container when the lid assembly engages said collar;

a reactive substance contained in the interior lid compartment and configured to undergo a change in at least one of its physical properties in response to a change of an environment condition at said aperture when the lid assembly engages said collar;

wherein said change in at least one of the physical properties of the reactive substance turns said lid assembly from a first operative condition wherein said lid assembly can be disengaged from said collar in order to open said aperture to a second operative condition wherein at least one portion of said lid assembly is prevented from disengaging from said collar and closes said aperture.

2. The container management system according to claim 1, wherein said at least one of the physical properties of the reactive substance is selected among volume, state of matter, adhesiveness.

3. The container management system according to claim 1, wherein said reactive substance comprises hydrogels or immunosensors or magnetoelastic sensors or gas sensors.

4. The container management system according to claim 1, wherein said lid assembly comprises a lid casing containing said interior lid compartment and having an upper portion and a lateral portion the lateral portion being configured to engage and disengage said collar.

5. The container management system according to claim 4, wherein said lid assembly comprises a membrane associated with said lid casing, said membrane being permeable to at least one gaseous substance and impermeable to said reactive substance, said reactive substance being arranged between said membrane and the upper portion of the lid casing.

6. The container management system according to claim 4, wherein said lid assembly comprises a lid internal cap arranged inside said lid casing and comprising an upper wall facing the upper portion of the lid casing and a lateral wall configured to couple with a radially inner surface of the collar.

7. The container management system according to claim 6, wherein said lid assembly comprises a membrane associated with said lid casing, said membrane being permeable to at least one gaseous substance and impermeable to said reactive substance, said reactive substance being arranged between said membrane and the upper portion of the lid casing, wherein said membrane defines at least one portion of said upper wall.

8. The container management system according to claim 6, wherein in the second operative condition of the lid assembly said reactive substance prevents said lid internal cap from disengaging from the collar.

9. The container management system according to claim 6, wherein said change in at least one of the physical properties of the reactive substance is a change of an adhesiveness of the reactive substance, the reactive substance coupling by adhesiveness said lid internal cap to said lid casing in the first operative condition of the lid assembly and decoupling said lid internal cap from said lid casing in the second operative condition of the lid assembly.

10. The container management system according to claim 6, wherein said lid internal cap and said collar are coupled through a bayonet coupling when the lid assembly engages said collar.

11. The container management system according to claim 6, wherein said lid internal cap and said collar comprise respective lower abutment surfaces configured to abut to each other when the lid assembly engages said collar in order to prevent the lid internal cap to fall inside the container in the second operative condition of the lid assembly.

12. The container management system according to claim 4, wherein in the second operative condition of the lid assembly said reactive substance irremovably couples said lid casing to said collar.

13. The container management system according to claim 12, wherein said lid assembly comprises a lid expansion space defined between said interior lid compartment and the lateral portion of the lid casing, said change in at least one of the physical properties of the reactive substance being a volume increase of the reactive substance and the reactive substance filling said lid expansion space in the second operative condition of said lid assembly.

14. The container management system according to claim 13, wherein said collar comprises an anchoring surface facing said lid expansion space when the lid assembly engages said collar, the reactive substance being far from said anchoring surface in the first operative condition of the lid assembly and engaging said anchoring surface in the second operative condition of the lid assembly.

15. The container management system according to claim 14, wherein said anchoring surface is annular and wedge shaped along an axial direction.

16. A lid assembly for a container, comprising:

an interior lid compartment;

a reactive substance contained in the interior lid compartment and configured to undergo a change in at least one of its physical properties in response to a change of an environment condition at the interior lid compartment;

wherein when the lid assembly is engaged to the container said change in at least one of the physical properties of the reactive substance turns said lid assembly from a first operative condition wherein said lid assembly can be disengaged from the container to a second operative condition wherein at least one portion of said lid assembly is prevented from disengaging from the container.

* * * * *